US008091366B2

(12) United States Patent
Grüger et al.

(10) Patent No.: US 8,091,366 B2
(45) Date of Patent: Jan. 10, 2012

(54) ARMOR-PLATED MACHINE COMPONENTS AND GAS TURBINES

(75) Inventors: Birgit Grüger, Dortmund (DE); Martin Stapper, Kamp-Lintfort (DE)

(73) Assignee: Siemens Aktiengesellschaft, Munich (DE)

( * ) Notice: Subject to any disclaimer, the term of this patent is extended or adjusted under 35 U.S.C. 154(b) by 483 days.

(21) Appl. No.: 12/227,912

(22) PCT Filed: Apr. 25, 2007

(86) PCT No.: PCT/EP2007/054029

§ 371 (c)(1),
(2), (4) Date: Dec. 2, 2008

(87) PCT Pub. No.: WO2007/141091

PCT Pub. Date: Dec. 13, 2007

(65) Prior Publication Data

US 2009/0180873 A1 Jul. 16, 2009

(30) Foreign Application Priority Data

Jun. 6, 2006 (EP) ..... 06011629

(51) Int. Cl.
*F02C 1/00* (2006.01)

(52) U.S. Cl. ..... 60/752

(58) Field of Classification Search ..... 60/752–760, 60/796–800; 416/96 A, 97 A
See application file for complete search history.

(56) References Cited

U.S. PATENT DOCUMENTS

| | | | | | |
|---|---|---|---|---|---|
| 3,476,283 | A | * | 11/1969 | Carson et al. | 220/586 |
| 4,688,310 | A | * | 8/1987 | Kelm et al. | 29/889.22 |
| 4,706,453 | A | * | 11/1987 | Vivace | 60/770 |
| 4,749,029 | A | * | 6/1988 | Becker et al. | 165/47 |
| 5,024,058 | A | * | 6/1991 | Shekleton et al. | 60/752 |

FOREIGN PATENT DOCUMENTS

| | | | |
|---|---|---|---|
| DE | 4238369 | A1 | 5/1994 |
| DE | 10326541 | A1 | 1/2005 |
| DE | 102004001722 | A1 | 8/2005 |
| EP | 0181255 | A1 | 5/1986 |
| EP | 1283278 | A2 | 2/2003 |
| GB | 1450894 | A | 9/1976 |
| GB | 2061397 | A | 5/1981 |

* cited by examiner

*Primary Examiner* — Louis Casaregola
*Assistant Examiner* — Phutthiwat Wongwian

(57) ABSTRACT

A machine component with a base body made of a base material, a part of the surface of which has been equipped with cladding material having a hardness greater in comparison to the base material. The cladding material is segmented and made up of a number of cladding segments that are spaced apart on the machine component. Each cladding segment may be disposed within a respective recess on the surface of the base body forming strips of the base body and material, and each such strip is disposed between consecutive segments forming a continuous surface.

12 Claims, 3 Drawing Sheets

ARMOR-PLATED MACHINE COMPONENTS AND GAS TURBINES

CROSS REFERENCE TO RELATED APPLICATIONS

This application is the U.S. National Stage of International Application No. PCT/EP2007/054029, filed Apr. 25, 2007 and claims the benefit thereof. The International Application claims the benefits of European application No. 06011629.0 filed Jun. 6, 2006, both of the applications are incorporated by reference herein in their entirety.

FIELD OF INVENTION

The invention relates to a machine component with a base body which is manufactured from a base material and which in a section of its surface is provided with a cladding consisting of a cladding material with a greater hardness in comparison to the base material. Furthermore, it relates to a gas turbine with a number of machine components of this type.

BACKGROUND OF THE INVENTION

Turbines, especially gas turbines, are used in many areas for driving generators or driven machines. In this case, the energy content of a fuel is used to produce a rotational movement of a turbine shaft. For this purpose, the fuel is combusted in a combustion chamber, wherein air, which is compressed by an air compressor, is supplied. The working medium, which is produced in the combustion chamber by means of the combustion of the fuel, is guided in the process at high pressure and at high temperature through a turbine unit, which is connected downstream to the combustion chamber, where it is expanded, performing work.

For producing the rotational movement of the turbine shaft, in this case a number of rotor blades, which are customarily assembled to form blade groups or blade rows, are arranged on said turbine shaft and drive the turbine shaft via an impulse transmission from the working medium. For guiding the working medium in the turbine unit, moreover, stator blade rows, which are connected to the turbine casing, are customarily arranged between adjacent rotor blade rows.

A turbine of this type comprises a large number of component parts or machine components which are suitably positioned in the turbine, subject to predetermined measurements, shapes and/or tolerances. In many cases, it can be desirable in the process to minimize the contact of adjacent machine components or component parts with each other, in order to keep wear of the affected component parts especially low by such means. However, during the operation of the turbine, time and again actually unwanted contact between such component parts can develop, for example as a result of thermal expansions or else as a result of operation-induced vibrations or suchlike which occur, so that certain wear of such component parts occurs. As such machine components, for example a so-called flame tube, a mixing chamber and an inner casing are customarily arranged adjacent to each other in the region of the combustion chamber of the gas turbine. Owing to their design, these machine components have such significant deformations and critical tolerances that during operation of the gas turbine contact between these component parts in some places is unavoidable. As a result of this contact, unwanted and possibly also critical wear, especially during long operating periods, arises, so that the component parts which are referred to have to be inspected at regular intervals and, if necessary, exchanged/repaired.

In order to keep the wear of the affected component parts or machine components especially low in such situations, the machine components can be manufactured in a so-called clad design, wherein the regions which are especially affected by the anticipated wear or the anticipated contacts with adjacent components are covered with a protective lining which is also referred to as cladding. Such a cladding in this case can be formed from a cladding material which in comparison to the base material of the respective components has a greater mechanical hardness, so that by means of such a suitable material selection contact-induced wear which occurs can already be reduced.

On account of the greater hardness of the cladding material which is customary for such application purposes, however, it On account of the greater hardness of the cladding material which is customary for such application purposes, however, it is also more brittle than the respective base material of the base body of the machine component. A further treatment of the base body which is provided with the cladding material, for example by bending or suchlike, is now only possible to a limited extent as a result. Furthermore, during a thermal expansion of the base body, crack formations or other damage can develop in the region which is provided with the cladding material, on account of the different thermal expansion behavior. Particularly for use in thermally comparatively highly stressed regions, such as in the inner region of the combustion chamber of a gas turbine, such clad machine components are only conditionally suitable as a result.

SUMMARY OF INVENTION

The invention, therefore, is based on the object of disclosing a machine component of the aforementioned-type which is also especially suitable for use in a thermally comparatively highly stressed region of a driven machine. Furthermore, a gas turbine with a number of such machine components is to be disclosed.

With regard to the machine component, this object is achieved according to the invention as claimed in the claims.

The invention in this case starts from the consideration that the machine component for a basic applicability should be provided with a suitable cladding, subject to low-wear operating conditions. In order to avoid the disadvantages which accompany this, especially with regard to the possibility of further treatment and also stability in relation to thermal stress, the lateral expansion of the cladding should be kept especially low. However, in order to be able to cover an adequately large section of the surface in the process, individual zones of the cladding should be designed in a manner in which they are decoupled from each other, in order to enable in this way adequate flexibility with respect to thermal deformation and suchlike. For this purpose, the cladding should be designed in segmented fashion.

In this case, especially component parts or machine components which are positioned adjacent to each other can also be designed in such a clad manner, wherein the clad section of the surface of a first machine component is arranged adjacent to the clad section of the surface of a second machine component. The cladding material of the first machine component in this case has a different hardness than the cladding material of the second machine component. By suitable material selection, therefore, it is possible, in the case of contact occurring between the two machine components to purposefully focus the wear on one of the two machine components, specifically that with the cladding of lesser hardness, wherein for this purpose especially the more easily exchangeable or repairable machine component can be selected.

The cladding segments can be applied to the base body of the machine component by means of suitable techniques. The cladding segments, however, are advantageously applied to the base body by means of weld surfacing, so that an especially intimate connection to the base body and, consequently, a high stability of the machine component is altogether achieved.

The cladding segments can be applied to an outer surface of the base body so that the contour which results from this basically has a multiplicity of projections on the surface of the rail component, which are formed by means of the cladding segments. However, in order to enable required measurements to be adhered to or else the provision of an externally smooth surface for the component part or the machine component, the cladding segments are advantageously introduced into or embedded in each case in associated recesses in the base body. As a result, an almost even overall surface of the machine component is altogether advantageously achievable, wherein especially the outer surface of the cladding segments and the outer surface of the strips of the base body which extend between the cladding segments form a continuous surface.

Machine components of the type mentioned are advantageously used in a gas turbine, especially as a flame tube of a combustion chamber, as a mixing chamber of a burner, and/or as an inner casing of a combustion chamber.

The advantages which are achieved by the invention are especially that, by means of the segmented design of the cladding of the machine component, attachment of the cladding to the base body is enabled really for the first time even in the case of only small tolerance ranges, wherein a distortion of the base body as a result of the high working temperatures during the weld surfacing can be largely avoided especially with regard to the segmented design of the cladding. By means of the segmented design of the cladding, moreover, crack formation during the application of the cladding, which could occur during continuous welding of the cladding, is avoided. Moreover, subsequent bending of the component part is enabled without the cladding material being too heavily stressed in the process. Furthermore, deformations and connecting welds during assembly and in operation are comparatively simple to carry out without fear of critical effects on the component part.

By means of the attachment of the cladding segments in recesses which are incorporated in the base body, the surface of the machine component can be homogenized in retrospect, wherein a possible projection after the weld surfacing can also be subsequently removed. In this case, the meeting of externally predetermined measurements can be ensured, especially in the case of matched component part geometry. The segmented application of the cladding, moreover, reduces the stressing of the component part during manufacture, assembly, and in operation.

Particularly in the application in turbines, especially gas turbines, moreover, by means of suitable material selection in the pair-wise cladding of component pairs by suitable selection of different hardnesses, the wear can be focused on one of the two paired components, so that subsequent maintenance and exchange of affected components can be made considerably easier.

BRIEF DESCRIPTION OF THE DRAWINGS

An exemplary embodiment of the invention is explained in detail based on a drawing. In the drawing.

Like components in all the figures are provided with the same designations.

DETAILED DESCRIPTION OF INVENTION

Figure 1:
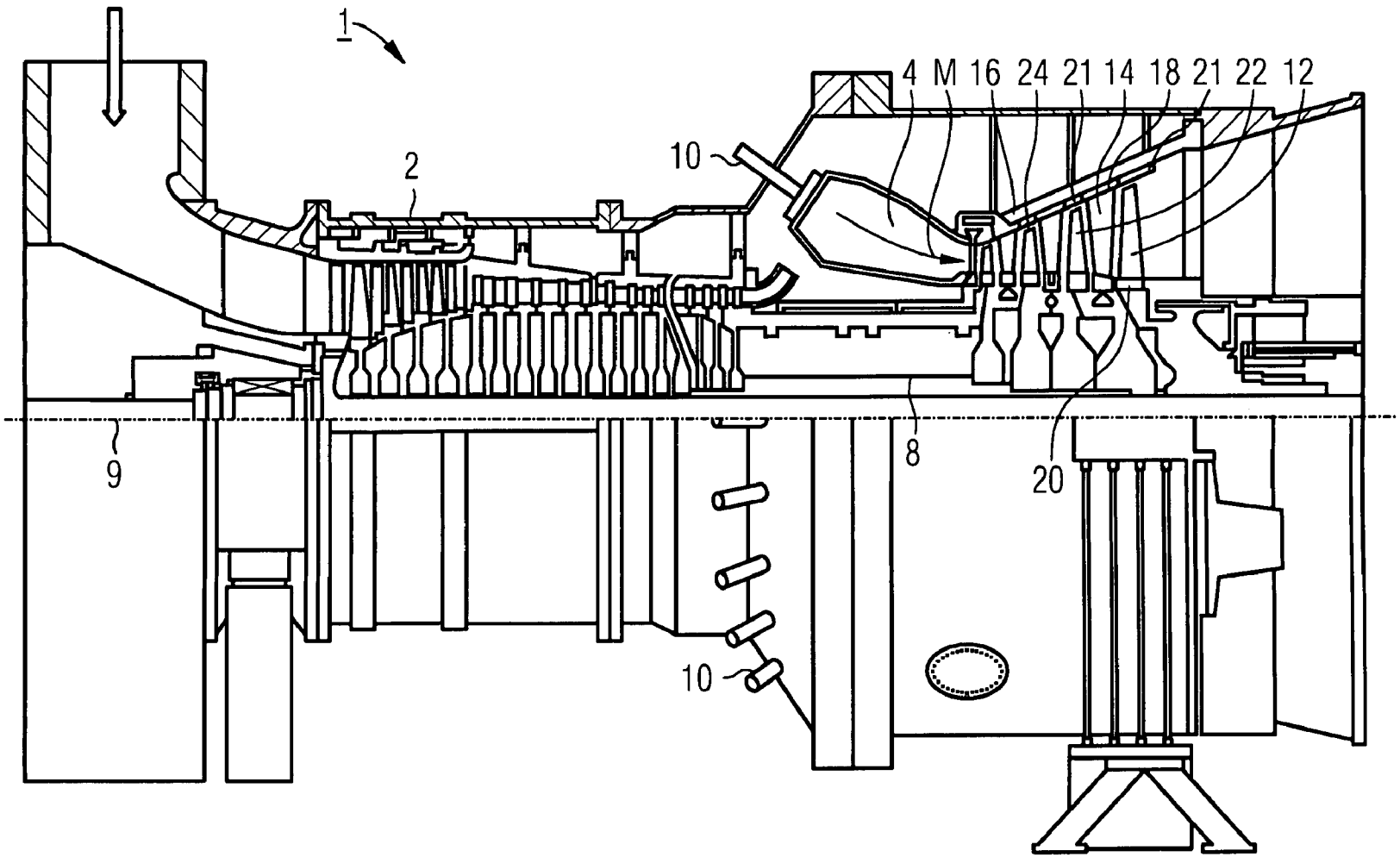
FIG. 1 shows a longitudinal section through a gas turbine.

The gas turbine 1 according to FIG. 1 has a compressor 2 for combustion air, a combustion chamber 4 and also a turbine 6 for driving the compressor 2, and a generator, not shown, or a driven machine. For this purpose the turbine 6 and the compressor 2 are arranged on a common turbine shaft 8, also referred to as a turbine rotor, to which the generator or the driven machine, as the case may be, is also connected, and which is rotatably mounted around its center axis 9.

The combustion chamber 4 is equipped with a number of burners 10 for combusting a liquid or gaseous fuel. Furthermore, on its inner wall it is provided with heat shield elements, which are not shown in detail.

The turbine 6 has a number of rotor blades 12 which are rotatably connected to the turbine shaft 8. The rotor blades 12 are arranged on the turbine shaft 8 in ring form and in this way form a number of rotor blade rows. Furthermore, the turbine 6 comprises a number of stationary stator blades 14 which are fastened on an inner casing 16 of the turbine 6, similarly in ring form, forming stator blade rows. The rotor blades 12 in this case serve for driving the turbine shaft 8 by impulse transmission from a working medium M which flows through the turbine 6. The stator blades 14, however, serve for flow guiding of the working medium M between two rotor blade rows or rotor blade rings which are in series in each case when viewed in the flow direction of the working medium M. A pair in series, consisting of one ring of stator blades 14 or one stator blade row, and consisting of one ring of rotor blades 12 or one rotor blade row, in this case is also referred to as a turbine stage.

Each stator blade 14 has a platform 18, which for fixing of the respective stator blade 14 on the inner casing 16 of the turbine 6 is arranged as a wall element. The platform 18 in this case is a thermally comparatively heavily stressed component part, which forms the outer boundary of a hot gas passage for the working medium M which flows through the turbine 6. Each rotor blade 12 is fastened on the turbine shaft 8 in a similar fashion via a platform 20 which is referred to as a blade root.

Between the platforms 18 of the stator blades 14 of two adjacent stator blade rows, which platforms are arranged at a distance from each other, a guide ring 21 is arranged on the inner casing 16 of the turbine 6 in each case. The inner surface of each guide ring 21 in this case is also exposed to the hot working medium M which flows through the turbine 6, and by means of a gap 24 is at a distance in the radial direction from the outer end 22 of the rotor blades 12 of a rotor blade row which lie opposite it.

Figure 2:
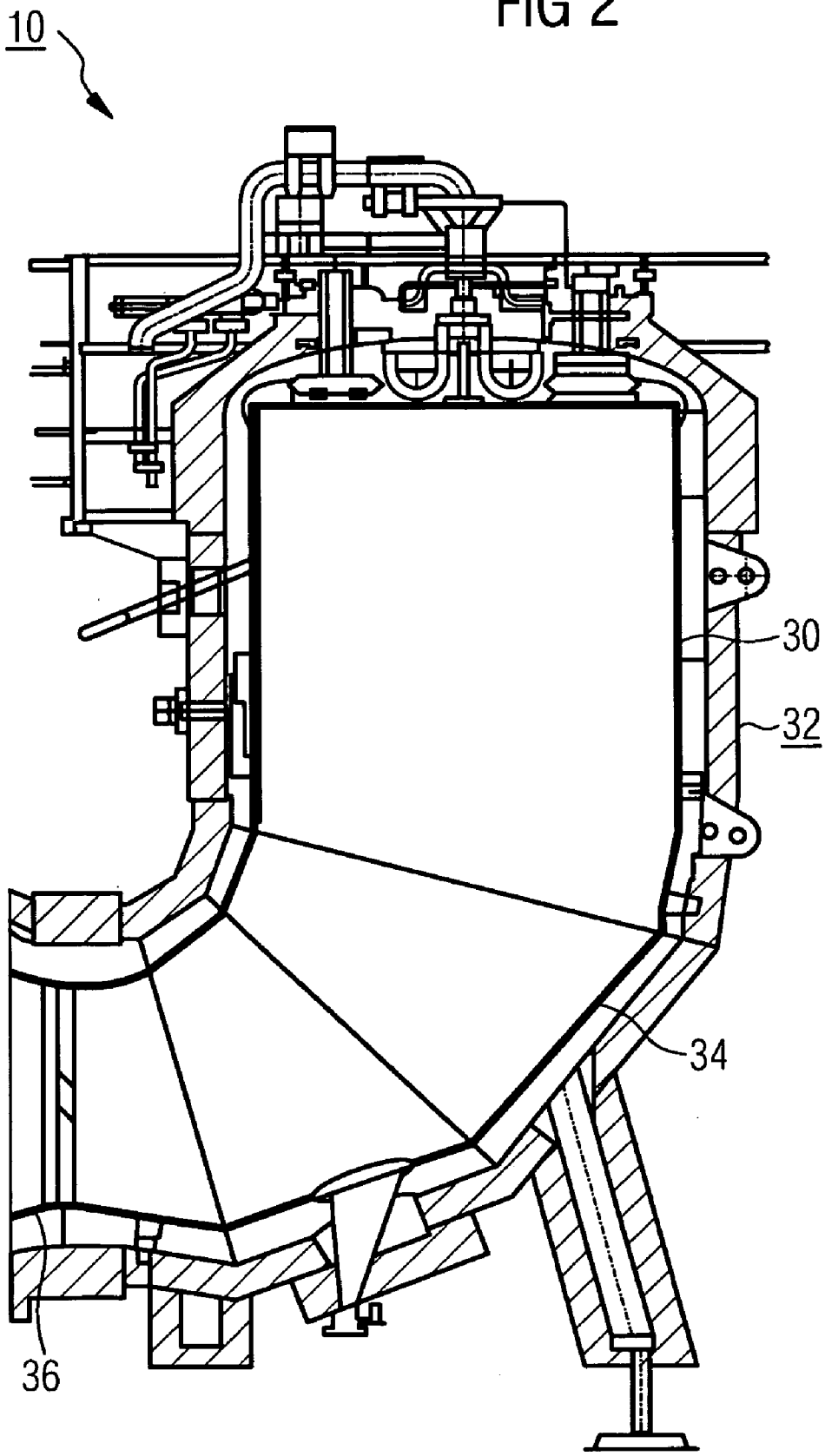
FIG. 2 shows a section through a combustion chamber in gas turbines, according to FIG. 1, and FIGS. 3 to 5 show machine components of the gas turbine in each case, according to FIG. 1.

As can be gathered from the enlarged view in FIG. 2, each of the combustion chambers 4 in its inflow section, to which are connected a number of feed lines for media like fuel and combustion air, which are not specified in detail, is equipped in its interior with a so-called flame tube 30, inside which the combustion of fuel takes place. Via a transition piece 34, which is similarly arranged inside the casing 32 of the respective burner 10 and which is also referred to as a mixing chamber, the flame tube 30 on the outlet side is connected to a mixing chamber 34 of the combustion chamber 4.

The flame tube 30, the transition piece 34 and the inner casing 36 are interconnected in this case in the fashion of tubes which are fitted into each other, so that reliable media flow guiding from the flame tube 30 into the inner casing 36 of the combustion chamber 4 is ensured. The pipe ends which are fitted into each other in each case, subject to the predetermined measurements and tolerances, are positioned in this case as contact-free as possible from each other, so that wear on account of components which come into contact with each other and components which rub upon each other is avoided as far as possible. However, constantly recurring contact of these components with each other, which is operationally induced during operation of the gas turbine 1, cannot be avoided, so that in any case a residual wear needs to be taken into account. In order to take this wear into account, a regular check and, if necessary, an exchange of these components is necessary within the scope of maintenance and inspection operations.

In order to keep the operational cost of the gas turbine 1 especially low and to largely simplify the necessary inspection and maintenance operations, the components of the gas turbine 1 are designed to be as wear-resistant as possible. In order to take into account in this case the wear which is induced by contact between the machine components, being the flame tube 30, transition piece 34 and inner casing 36, and particularly to keep this wear especially low during occurring contacts of the components with each other, the machine components which are referred to are designed as clad components. For this purpose, each of the machine components, being the flame tube 30, transition piece 34 and inner casing 36, is constructed from a base body 40 which is manufactured from base material and which in a section of its surface, which is shown in FIGS. 3 to 6 in each case, is provided with a cladding 42 consisting of a cladding material. The cladding material in this case is selected in such a way that it has a greater hardness in comparison to the base material, so that an increased resistance to mechanical and also thermal stress is given. The cladding material in this case is applied to the base body 40 in each case by means of weld surfacing.

In order to avoid an impairment of the manufacture, assembly and also operation of the respective machine components as a result of the cladding 42, as it could occur, for example, as a result of the different thermal expansion behavior and crack formation associated with this during the actual welding process, or else during operation with increased thermal stress, the cladding 42 of the respective machine component is designed in segmented fashion. For this purpose, the cladding 42 comprises a plurality of cladding segments 44, wherein the dimensioning with regard to the dimensioning of the actual machine component and the materials which are used is selected in such a way that, as a result of the laterally limited expansion of the respective cladding segment 44, a too large impairment of the base body 40 by different thermal expansion behavior and suchlike is avoided.

Figure 3:
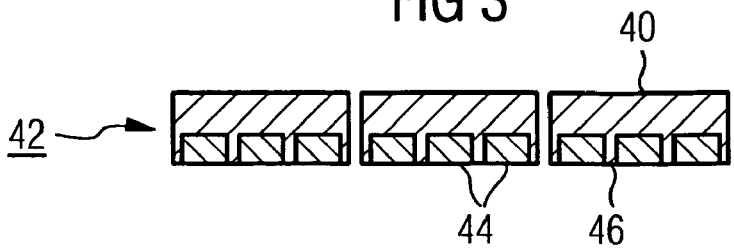

As can be gathered from the view in FIG. 3, the cladding segments 44 are introduced into associated recesses in the base body 40 in each case. The recesses in this case could have been made by suitable machining processes, such as by milling, turning or grinding. The dimensioning in this case can basically be undertaken in such a way that the cladding segments 44 are applied to a level surface of the base body 40 and recesses which correspond to their thickness are formed between them accordingly. During the attachment of the cladding segments 44, the fabrication, however, as this is shown in FIGS. 3 to 6, can also be carried out in such a way that the outer surface of the cladding segments 44 with the outer surface of the strips 46 of the base body 40 which extend between the outer cladding segments 44 form a continuous and therefore level surface. As a finished machine component in this case a component part results which with regard to its shaping, dimensioning and dimensional accuracy corresponds as far as possible to an originally provided component part, and especially has a correspondingly smooth and planar surface.

Figure 4:
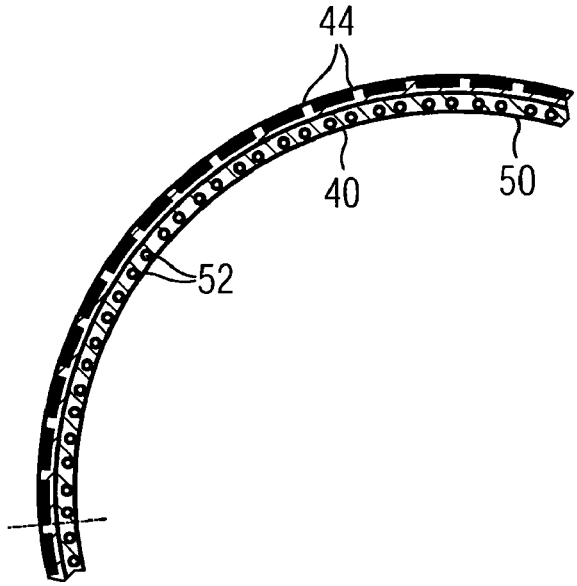

In FIG. 4, it is shown that a curved cooling air ring 50 can also be designed as an at least partially clad machine component of the type which is referred to. The cooling air ring 50 in this case is also provided with cladding segments 44 on its surface, which are incorporated in corresponding recesses of the base body 40 which forms the cooling air ring 50. In this case, cooling air passages 52, which are formed by corresponding holes, are additionally also provided in the base body 40 of the cooling air ring 50. By means of the forming-out of the recesses, which are also referred to as pockets, in which the cladding segments 44 are arranged in this case, the desired geometry of the cooling air ring 50 can be maintained. Nevertheless, when using the cladding segments 44, an almost even surface and an even transition to the base body 40 is also created. As a result of this, an enhanced wear reduction and an improved binding between the materials which are used is ensured.

Figure 5:
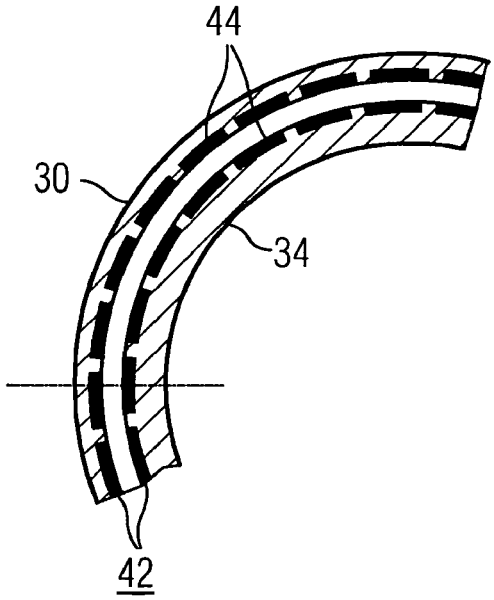

In FIG. 5, it is shown that especially the transition piece 34 and the flame tube 30 of the gas turbine 1 in their overlapping region are designed as such clad machine components. Claddings 42 of these machine components are provided in this case on the surface segments which face each other in each case. In such an adjacent arrangement of two such clad machine components, moreover, as this is provided in the present case for the transition piece 34 and the flame tube 30, a purposeful focusing of the wear on one of the two machine components, especially on the machine component which is more easily exchangeable, is enabled by means of a suitable material selection for the claddings 42. For this purpose, it is specifically intended in the present case to select the cladding material for the cladding 42 of the flame tube 30 to be of lesser hardness than the material for the cladding 42 of the transition piece 34.

The invention claimed is:

1. A gas turbine machine having a first and second machine component positioned adjacent to one another and subject to wear as a result of contact between the components during operation of the machine, comprising:

a base body for the first component having an inner surface that exposed to combustion gas flows and outer surface; and a base body for the second component having an inner and outer surface;

a cladding material arranged on a section of the inner surface of the base body of the first machine component and having a greater hardness than a base material of the first machine component thereby reducing wear of the first component resulting from contact with the second machine component;

a cladding material arranged on a section of the outer surface of the base body of the second machine thereby reducing wear resulting from contact with the first machine component;

wherein the cladding material on each of the first and second machine components is segmented and formed from a plurality of cladding segments and spaced apart from one another, with a clad segments on the inner surface of the first machine component arranged adjacent to clad segments on the outer surface of the second machine component, and the cladding material of the first machine component has a different hardness than the cladding material of the second machine component.

2. The machine component as claimed in claim 1, wherein cladding segments on either the first or second machine component are applied to the base body via weld surfacing.

3. The machine component as claimed in claim 2, wherein cladding segments on either the first or second machine component are introduced into associated recesses in the base body.

4. The machine component as claimed in claim 1, wherein the cladding segments on the first and second machine component are disposed within corresponding recesses in the respective inner and outer surfaces of the base bodies forming a strips of the base body which extends between consecutive cladding segments wherein outer surfaces of the cladding segments and the strips form a coplanar continuous surface on the respective machine component.

5. A gas turbine, comprising:

an inlet section that admits a working fluid;

a compressor section that compresses the working fluid;

a combustion section that mixes a fuel with the compressed working fluid and provides a hot working fluid;

a turbine section that expands the hot working fluid to produce mechanical power; and a first and second machine component positioned adjacent to one another and subject to wear as a result of contacting one another during operation of the turbine wherein:

a base body for the first machine component having an inner and outer surface, a base body for the second machine component having an inner and outer surface, a cladding material arranged on a section of the inner surface of the base body of the first machine component and having a greater hardness than a base material of the first machine component thereby reducing wear of the first machine component resulting from contact with the second machine component surface;

a cladding material arranged on a section of the outer surface of the base body of the second machine component and having a greater hardness than base material of the second machine component thereby reducing wear of the second machine component resulting from contact with the first machine component wherein, the cladding material on each of the first and second machine components is segmented and formed from a plurality of spaced apart cladding segments, with the clad segments on the first machine component arranged adjacent to the clad segments on the second machine component, the cladding material of the first machine component has a different hardness than the cladding material of the second machine component.

6. The gas turbine as claimed in claim 5, wherein the either the first or second machine component is at least a flame tube of a combustion chamber, a mixing chamber of a combustion chamber and/or an inner casing of a combustion chamber.

7. The gas turbine as claimed in claim 6, wherein the cladding segments on the first and/or second machine components are applied to the base body via weld surfacing.

8. The gas turbine as claimed in claim 7, wherein the cladding segments are introduced into associated recesses in the base body of either the first or second machine components.

9. The gas turbine as claimed in claim 5, wherein the cladding segments on the first and second machine component are disposed within corresponding recesses in the respective inner and outer surfaces of the base bodies forming a strip of the base body which extends between consecutive cladding segments wherein outer surfaces of the cladding segments and the strips form a continuous coplanar surface on the respective machine component.

10. A gas turbine machine comprising:

a first machine component positioned adjacent to a second machine component and the first machine component is subject to wear as a result contact with the second machine component and the first and second machine components each having an internal volume through which a combustion gas flows;

a cladding material on a surface of the first machine component, wherein the cladding material is arranged in a plurality of cladding segments spaced apart on the first machine component;

a cladding material on an outer surface of the second machine component, wherein the cladding material of the second machine component is arranged in a plurality of spaced apart cladding segments;

and, wherein each cladding segment of the first machine component is disposed within a corresponding recess formed in the first machine component thereby forming a plurality of strips in the first machine component and each strip is disposed between consecutive cladding segments and the cladding segments and strips forming a continuous coplanar surface on the first machine component.

11. The gas turbine machine as claimed in claim 10 wherein an inner surface of the first machine component is positioned adjacent an outer surface of the second machine component, and the cladding segments on the inner surface of the first machine component adjacent to the outer surface of the second machine component.

12. The gas turbine machine as claimed in claim 11 wherein the cladding material of the second machine component is arranged in a plurality of spaced apart cladding segments, and each cladding segment is disposed within a corresponding recess formed in the second machine component thereby forming a plurality of strips in the outer surface of the second machine component and each strip is disposed between consecutive cladding segments and the cladding segments and strips forming a continuous surface on the first machine component.

* * * * *